US008475131B2

(12) United States Patent
Shibata et al.

(10) Patent No.: US 8,475,131 B2
(45) Date of Patent: Jul. 2, 2013

(54) CENTRIFUGAL COMPRESSOR

(75) Inventors: Takanori Shibata, Hitachinaka (JP); Manabu Yagi, Tsuchiura (JP); Hideo Nishida, Kasumigaura (JP); Hiromi Kobayashi, Kasumigaura (JP); Masanori Tanaka, Tsuchiura (JP); Tetsuya Kuwano, Tsuchiura (JP)

(73) Assignee: Hitachi Plant Technologies, Ltd., Tokyo (JP)

( * ) Notice: Subject to any disclaimer, the term of this patent is extended or adjusted under 35 U.S.C. 154(b) by 894 days.

(21) Appl. No.: 12/623,089

(22) Filed: Nov. 20, 2009

(65) Prior Publication Data

US 2010/0129224 A1 May 27, 2010

(30) Foreign Application Priority Data

Nov. 21, 2008 (JP) ..... 2008-298820

(51) Int. Cl.
*F04D 29/38* (2006.01)

(52) U.S. Cl.
USPC ..... 416/182; 416/188

(58) Field of Classification Search
USPC ..... 415/228; 416/182, 185, 186 R, 188
See application file for complete search history.

(56) References Cited

U.S. PATENT DOCUMENTS

| | | | |
|---|---|---|---|
| 5,685,696 | A | 11/1997 | Zangeneh et al. |
| 6,062,819 | A | 5/2000 | Zangeneh et al. |
| 2009/0035122 | A1 | 2/2009 | Yagi et al. |

FOREIGN PATENT DOCUMENTS

| | | | |
|---|---|---|---|
| JP | 60-108596 | | 6/1985 |
| JP | 02-037297 | | 3/1990 |
| JP | 10-504621 | A | 5/1998 |
| WO | WO 95/34744 | | 12/1995 |
| WO | WO 95/34744 | A1 | 12/1995 |

OTHER PUBLICATIONS

European Patent Office extended search report on application 09176656.8 dated Jun. 6, 2012; 6 pages.

*Primary Examiner* — Dwayne J White
(74) *Attorney, Agent, or Firm* — Foley & Lardner LLP

(57) ABSTRACT

A centrifugal compressor provided with an impeller which is configured to have a plurality of blades arranged at a predetermined interval in a circumferential direction of a hub rotating together with a rotation shaft, in which a blade angle on a shroud side of the blade distributes to have a minimum value at a position between a leading edge of the blade and a midpoint of a camber line on the shroud side, and a maximum value at a position between the midpoint of the camber line on the shroud side and a trailing edge of the blade, and a blade angle of the blade on a hub side distributes so as to have a maximum value at a position between a leading edge and a midpoint of a camber line on the hub side.

8 Claims, 9 Drawing Sheets

CENTRIFUGAL COMPRESSOR

CROSS REFERENCE TO RELATED APPLICATIONS

This application claims the foreign priority benefit under Title 35, United States Code, §119(a)-(d) of Japanese Patent Application No. 2008-298820, filed on Nov. 21, 2008, the contents of which are hereby incorporated by reference.

FIELD OF THE INVENTION

The present invention relates to a centrifugal compressor provided with a centrifugal impeller, and more particularly to a shape of a blade of the centrifugal impeller.

DESCRIPTION OF RELEVANT ART

A centrifugal compressor which compresses a fluid by a rotating impeller (centrifugal impeller) has been widely used for various kinds of plant. Recently, there is a tendency to emphasize a life cycle cost including an operational cost in view of energy (energy saving) and environmental issues, and the centrifugal compressor which has a wide operating range and high efficiency has been expected.

When a centrifugal compressor is operated at a constant rotation speed, an operating range of the centrifugal compressor is defined by an area between a surge limit which is a limit on the side of a small flow rate and a choke limit which is an operating limit on the side of a large flow rate. When a flow rate of gas (working fluid) flowing into the centrifugal compressor is reduced below the surge limit, the centrifugal compressor can not be operated stably by fluctuations of the discharge pressure and flow rate due to separation of flow inside the centrifugal compressor.

In addition, when the flow rate is attempted to increase more than the choke limit, a velocity of the working fluid inside the centrifugal compressor reaches the sonic speed. Then, the flow rate of the working fluid can not be increased more than the choke limit.

Therefore, the centrifugal compressor is operated so that the flow rate of the working fluid is between the surge limit and the choke limit.

For example, in JP H10-504621, a technology for improving the efficiency and expanding the operating range by considering a loading distribution of an impeller of a centrifugal compressor is disclosed. Specifically, a generation of a secondary flow inside the impeller is suppressed by concentrating the loading of the shroud side on the leading edge side (upstream side) and the loading of the hub side on the trailing side (downstream side) for expanding the operating range and improving the efficiency.

According to the studies of inventors of the present invention, it was found that the operating range of a centrifugal compressor is further expanded by improving a loading distribution from a leading edge portion (leading edge side of blade) of the shroud side of the impeller to the vicinity of a throat position, and the efficiency (pressure ratio) is further improved, accordingly.

However, there is no description on the loading distribution from the leading edge portion of the shroud side to the vicinity of the throat position in JP H10-504621, and there is room for improvement for expanding the operating range and improving the efficiency of the centrifugal compressor.

In addition, since the strength of the impeller is not studied in JP H10-504621, there may be a case where the impeller which rotates at high speed and has a large circumferential velocity is not applied.

It is, therefore, an object of the present invention to provide a centrifugal compressor provided with an impeller which can improve the efficiency as well as expand the operating range, and further can increase a circumferential velocity.

SUMMARY OF THE INVENTION

For solving the foregoing problems, in a centrifugal compressor according to the present invention, a blade angle distribution from a leading edge to a trailing edge of a blade provided in an impeller is determined based on a loading distribution of the blade.

According to the present invention, a centrifugal compressor provided with an impeller, which can improve the efficiency as well as expand the operating range, and further can increase a circumferential velocity, can be provided.

DETAILED DESCRIPTION OF THE PREFERRED EMBODIMENT

<<First Embodiment>>

Hereinafter, a preferred embodiment of the present invention will be explained by referring to drawings as appropriate.

Figure 1:
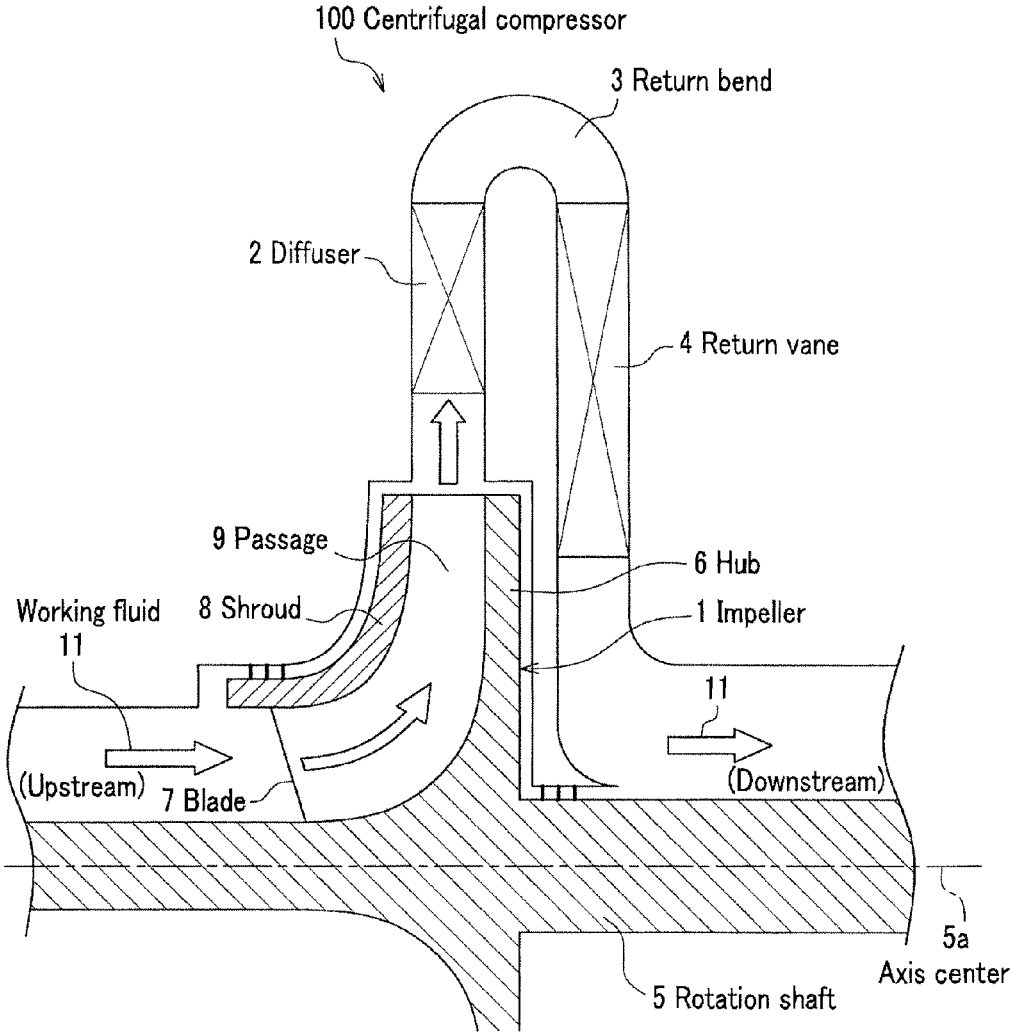
FIG. 1 is a cross sectional view showing a part of a structure of a centrifugal compressor according to a first embodiment of the present invention.
Figure 2:
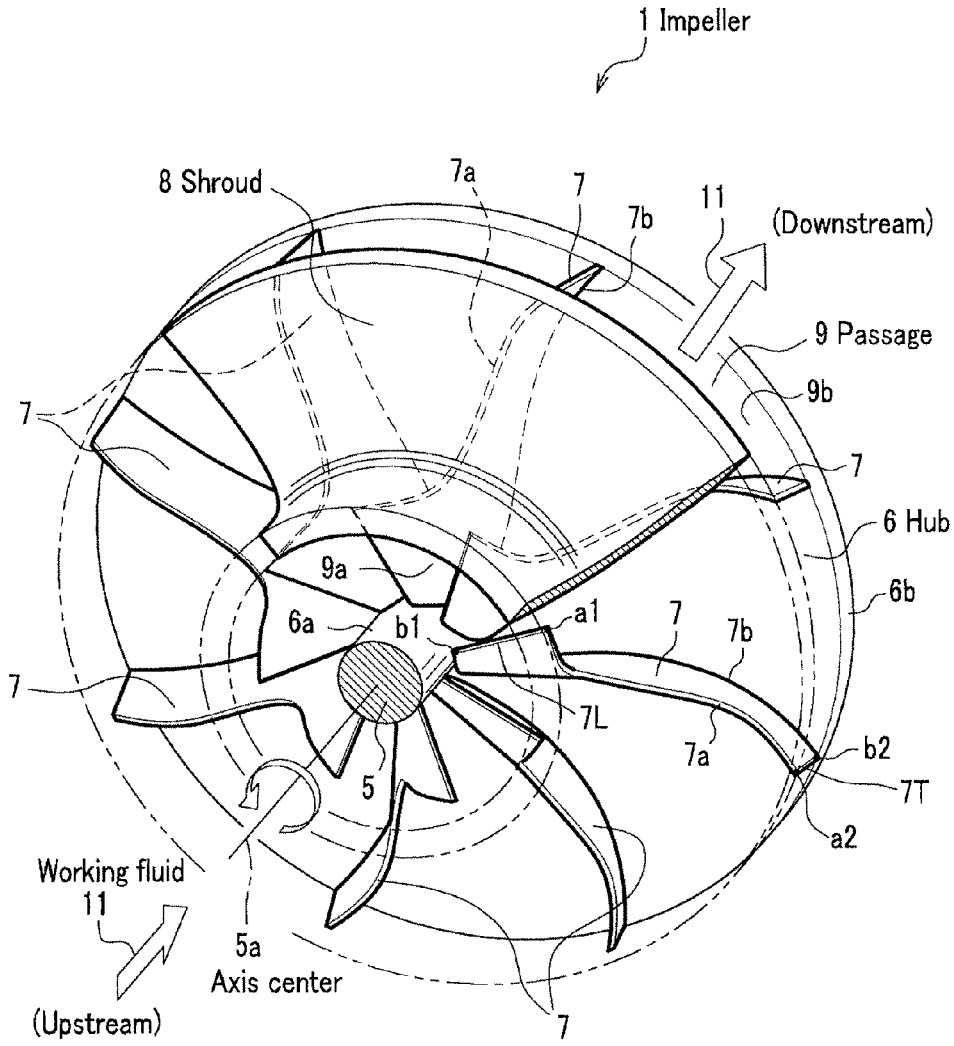
FIG. 2 is a perspective view showing a structure of an impeller.

FIG. 1 is a cross sectional view showing a part of a structure of a centrifugal compressor according to a first embodiment of the present invention, and FIG. 2 is a perspective view showing a structure of an impeller.

As shown in FIG. 1, a centrifugal compressor 100 includes an impeller 1 which is provided with a blade 7 and rotates around an axis center 5*a* together with a rotation shaft 5, a diffuser 2 which forms a passage of a working fluid 11, a return bend 3 and a return vane 4.

Although not shown in FIG. 1, it is noted that the impeller 1, the diffuser 2, the return bend 3 and return vane 4 constitute a single stage and the centrifugal compressor 100 consists of a plurality of the stages arranged in series. That is, a working fluid 11 passed through the return vane 4 in the preceding stage flows into the subsequent stage, and the working fluid 11 is sequentially compressed.

Hereinafter, "upstream" indicates an upstream of a flow of the working fluid 11 and "downstream" indicates a downstream of the flow of the working fluid 11.

As shown in FIG. 2, the impeller 1 is formed in such a manner that a plurality of blades 7 are disposed toward the upstream of a hub 6 which rotates together with the rotation shaft 5 rotating around the axis center 5*a*. For example, a center portion 6*a* of the hub 6, which is fixed to the rotation shaft 5, gradually expands toward the downstream forming a flange-shape, and the blade 7 which is a plate-like member is vertically disposed along a shape of the hub 6 in the upstream.

The blade 7 is approximately radially formed toward an edge portion 6*b* of the hub 6 from a center portion 6*a*, and a height of the blade 7 is formed to become higher toward the center portion 6*a* from the edge portion 6*b*. Meanwhile, the height of the blade 7 is a length from the hub 6 in a direction leaving from the hub 6.

In addition, the blade 7 is formed by such a curved surface that an end of the center portion 6*a* of the hub 6 is twisted in a rotation direction of the impeller 1.

A shape of the blade 7 will be described later in detail.

A shroud 8 which is supported by the blade 7 is provided facing the hub 6, and a plurality of passages 9 surrounded by two blades 7, 7, the hub 6 and the shroud 8 are formed.

It is noted that an illustration where the shroud 8 is partially formed is shown in FIG. 2. However, this is for showing a shape of the blade 7, and the shroud 8 is provided in entire circumference of the hub 6.

Meanwhile, an "open impeller" may be possible, where the passage 9 is formed by two blades 7, 7 and the hub 6 without using the shroud 8.

It is noted that, even in the "open impeller", a side opposite to the hub 6 with respect to the blade in the height direction thereof is called a side of a shroud.

When the working fluid 11 flowing along the rotation shaft 5 reaches an inlet 9*a*, which is opened to the upstream of the passage 9, the working fluid 11 flows into the passage 9 along the blade 7 by a rotation of the impeller 1. In addition, a pressure of the working fluid 11 is increased by the rotation of the impeller 1, and discharged from an outlet 9*b* which is opened to the downstream of the passage 9. After that, the working fluid 11 flows into the diffuser 2 shown in FIG. 1.

A flowing velocity of the working fluid 11 flown into the diffuser 2 in FIG. 1 is reduced by a plurality of blades (not shown) and a static pressure is recovered. Then, the working fluid 11 flows into the impeller 1 in the subsequent stage provided in the downstream through the return bend 3 and the return vane 4.

As described above, the flowing velocity of the working fluid 11 is reduced by the plurality of blades, which are not shown, fixed to the diffuser 2, and a loss when the working fluid 11 flows into the return bend 3 can be decreased, thereby resulting in improvement of efficiency of the centrifugal compressor 100.

As shown in FIG. 2, the blade 7 includes a camber line (hereinafter, referred to as hub curve line 7*b*) on a side of the hub 6 and a camber line (hereinafter, referred to as shroud curve line 7*a*) on the side of the shroud 8.

End portions of the shroud curve line 7*a* and the hub curve line 7*b* in the upstream are named leading edge portions a1, b1, respectively, and those in the downstream are named trailing edge portions a2, b2, respectively.

An edge connecting the leading edge portion a1 and the leading edge portion b1 forms a leading edge 7L of the blade 7, and the edge connecting the trailing edge portion a2 and the trailing edge portion b2 forms a trailing edge 7T of the blade 7.

As described above, the blade 7 according to the first embodiment forms a three-dimensional shape where a shape on the side of the hub 6 is defined by the hub curve line 7*b* and a shape on the side of the shroud 8 is defined by the shroud curve line 7*a*.

The shroud curve line 7*a* and the hub curve line 7*b* according to the first embodiment are curves which are digitized by the blade angle.

Figure 3A:
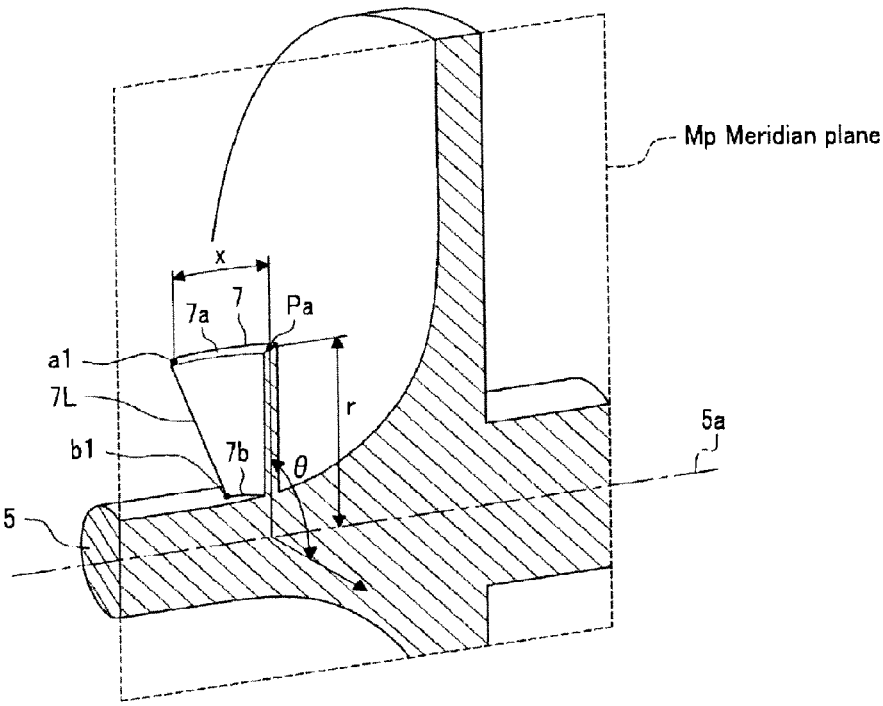
FIG. 3A is a cross sectional view of an impeller cut at a meridian plane for explaining a blade angle.
Figure 3B:
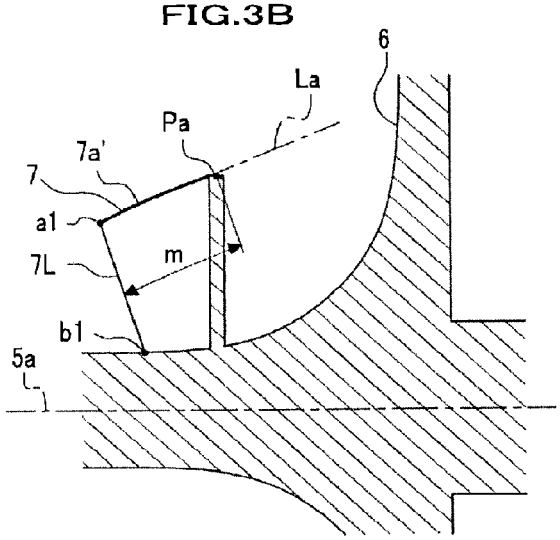
FIG. 3B is a cross sectional view of the impeller as seen from a meridian plane for explaining the blade angle.
Figure 3C:
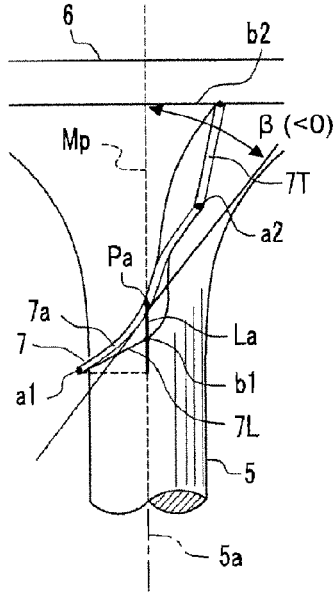
FIG. 3C is an illustration showing the blade angle for explaining the blade angle.

FIG. 3A is a cross sectional view of an impeller cut at a meridian plane for explaining the blade angle, FIG. 3B is a cross sectional view of the impeller as seen from the meridian plane, and FIG. 3C is an illustration showing the blade angle.

As shown in FIG. 3A, a meridian plane Mp at an arbitrary point Pa on the shroud curve line 7*a* of the blade 7 is a plane including the axis center 5*a* and passing through the point Pa.

The meridian plane Mp described above is different depending on a position on the shroud curve line 7*a* and a position on the hub curve line 7*b*.

Meanwhile, x shown in FIG. 3A is a length which is measured from the leading edge portion a1 to the point Pa along the shroud curve line 7*a*, and called as a camber line length.

A blade angle β is an angle which is formed between the blade 7 and the meridian plane. The blade angle β between the shroud curve line 7*a* and the meridian plane and the blade angle β between the hub curve line 7*b* and the meridian plane have different values. In addition, the blade angle β has a different value depending on a position on the shroud curve line 7*a* and a position on the hub curve line 7*b*.

In the first embodiment, the blade angle β (blade angle β on the side of the shroud curve line 7*a*) at the point Pa on the shroud curve line 7*a* of the blade 7 is defined as follows.

As shown in FIG. 3B, a projected line 7*a*' is obtained by projecting the shroud curve line 7*a* on the meridian plane at the point Pa. In addition, a baseline La on the meridian plane Mp which is tangent to the projected line 7*a*' at the point Pa is obtained.

Then, as shown in FIG. 3C, the blade angle β which is an angle between the baseline La and the blade 7 is formed on a plane orthogonal to the meridian plane Mp at the baseline La.

It is noted that a positive direction of the blade angle β is a rotation direction of the impeller 1 and a negative direction of the blade angle β is the reverse direction of the rotation direction.

In addition, as shown in FIG. 3A, a distance between the point Pa and the axis center 5*a* is named as a radius r, an angle formed between the radius r and a horizontal direction is named as a circumferential direction position θ, and a length which is formed by projecting a length between the leading edge portion a1 and the point Pa of the shroud curve line 7*a* on the meridian plane Mp, that is, a meridional length which is a length of the projected line 7*a*' shown in FIG. 3B is named as m. Then, the blade angle β can be expressed in the next formula (1)

$$\tan\beta = r \cdot \frac{d\theta}{dm} \quad (1)$$

A shape of the shroud curve line 7*a* of the blade 7 is determined by continuously setting the blade angle β (blade angle β on the side of the shroud curve line 7*a*) from the leading edge portion a1 to the trailing edge portion a2. Similarly, a shape of the hub curve line 7*b* is determined by continuously setting the blade angle β (blade angle β on the side of the hub curve line 7*b*) from the leading edge portion b1 to the trailing edge portion b2.

Accordingly, the blade 7 is formed by smoothly connecting the shroud curve line 7*a* and the hub curve line 7*b*, for example, by connecting linearly.

A shape of the blade 7 formed as described above is an important element which determines a performance of the impeller 1. Therefore, it is required to optimally determine the shape of the blade 7 for obtaining a centrifugal compressor 100 (see FIG. 1) which has a wide operating range and high efficiency.

Figure 4:
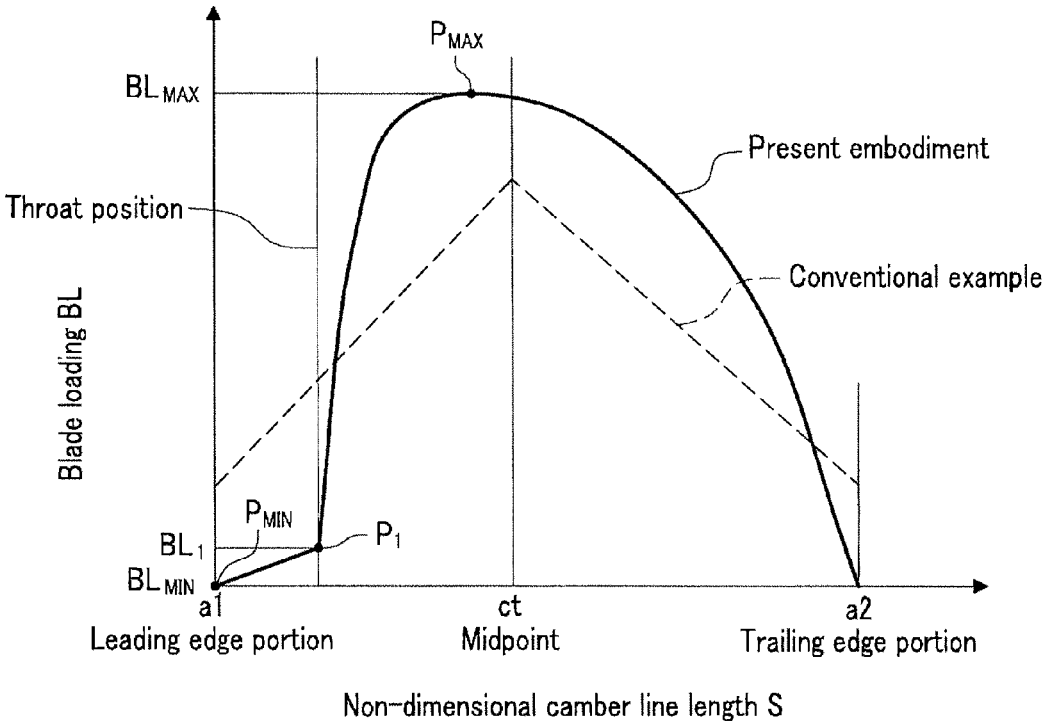
FIG. 4 is a graph showing a blade loading distribution along a shroud curve line against a non-dimensional camber line length.

FIG. 4 is a graph showing a blade loading distribution along a shroud curve line against a non-dimensional camber line length. The vertical axis in FIG. 4 indicates a load (blade loading BL) on the blade 7 on the side of the shroud curve line 7*a* shown in FIG. 2, and the horizontal axis indicates a non-dimensional camber line length S of the shroud curve line 7*a* shown in FIG. 3C.

The non-dimensional camber line length S is a non-dimensional number which is calculated by dividing the camber line length x shown in FIG. 3A by a length (whole length) of the shroud curve line 7*a*. Similarly, with respect to the hub curve line 7*b*, the non-dimensional camber line length S is a non-dimensional number which is calculated by dividing a camber line length, which is a length measured along the hub curve line 7*b* from the leading edge portion b1 to an arbitrary point on the hub curve line 7*b*, by a length (whole length) of the hub curve line 7*b*.

A middle point ct is a point where both the non-dimensional camber lines S of the shroud curve line 7*a* and the hub curve line 7*b* become 0.5 (half), and in the shroud curve line 7*a*, it is a midpoint (midpoint of the shroud curve line 7*a*) between the leading edge portion a1 and the trailing edge portion a2 along the shroud curve line 7*a*, and in the hub curve line 7*b*, it is a midpoint (midpoint of the hub curve line 7*b*) between the leading edge portion b1 and the trailing edge portion b2 along the hub curve line 7*b*.

The blade loading BL is an index indicating a velocity difference and a pressure difference of the working fluid 11 (see FIG. 2), which flows on both sides of the blade 7, between both sides of the blade 7, and a velocity reduction rate of the working fluid 11 flowing inside the impeller 1 (see FIG. 2) increases as the blade loading BL becomes larger.

Figure 5:
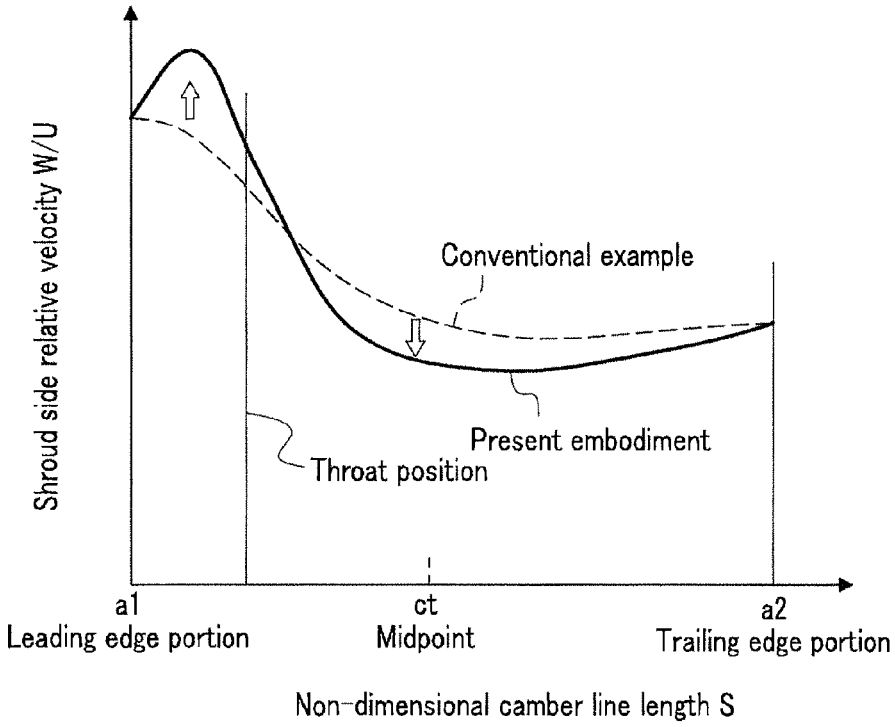
FIG. 5 is a graph showing a relative velocity of a working fluid on a side of a shroud against a non-dimensional camber line length.

FIG. 5 is a graph showing a relative velocity of a working fluid on a side of a shroud against a non-dimensional camber line length. The vertical axis in FIG. 5 indicates a shroud side relative velocity (W/U) calculated as follows. An average velocity W is calculated by averaging a relative velocity relative to the blade 7 (see FIG. 2) of the working fluid 11 (see FIG. 2) on the side of the shroud curve line 7*a* in the circumferential direction. The average velocity W is divided by a circumferential velocity U on the side of the shroud curve line 7*a* of the impeller 1 (see FIG. 2) to calculate the shroud side relative velocity (W/U). The horizontal axis indicates a non-dimensional camber line length S of the shroud curve line 7*a*.

The shroud side relative velocity (W/U) of the working fluid 11 (see FIG. 2) is a velocity which is obtained by subtracting a circumferential velocity (velocity in circumferential direction) component in the rotation direction of the impeller 1 (see FIG. 1) from a main flow velocity of the working fluid 11 in the direction along the rotation shaft 5 (see FIG. 2). Since the shroud 8 (see FIG. 2) is located on the outer circumferential side and the hub 6 (see FIG. 2) is located on the inner circumferential side, a circumferential velocity on the side of the shroud 8 becomes inevitably faster than that on the side of the hub 6. Accordingly, the shroud side relative velocity (W/U) on the side of the shroud 8 becomes faster than the relative velocity on the side of the hub 6. Since an aerodynamic loss is substantially proportional to the square of a relative velocity, a relative velocity distribution on the side of the shroud largely effects on a performance of the centrifugal compressor 100 (see FIG. 1). Therefore, by optimally designing a shape of the blade 7 on the side of the shroud 8, that is, by optimally designing a shape of the shroud curve line 7*a* (see FIG. 2), a performance of the centrifugal compressor 100 can be secured.

Conventionally, as shown by a dotted line in FIG. 4, a blade loading BL along the shroud curve line 7*a* shown in FIG. 2 linearly goes up at a constant rate from the leading edge portion a1 of the shroud curve line 7*a* (see FIG. 2) as the non-dimensional camber line length S increases, and reaches a maximum value at around the midpoint ct of the non-dimensional camber line length S. In addition, the blade loading BL decreases linearly at a constant rate as the non-dimensional camber line length S further increases.

If the blade loading BL distributes from the leading edge portion a1 toward the trailing edge portion a2 as with the conventional example shown by the dotted line in FIG. 4, the shroud side relative velocity (W/U) of the working fluid 11 (see FIG. 2) has a maximum value (largest value) at the leading edge portion a1 and then decreases reaching the trailing edge a2 as with the conventional example shown by a dotted line in FIG. 5.

However, from recent study results by the inventors of the present invention, it was found that a reverse flow to be generated at the leading edge portion a1 when a flow rate of the working fluid 11 was decreased causes an occurrence of a surge. Therefore, for delaying the occurrence of the surge, it is preferable to increase the shroud side relative velocity (W/U) of the working fluid 11 at the leading edge portion a1 to suppress the reverse flow.

On the other hand, for decreasing a fluid loss of the working fluid 11 flowing in the passage 9 of the impeller 1 shown in FIG. 1, and for improving the efficiency of the centrifugal compressor 100, it is preferable that a relative velocity on the side of the shroud 8 (see FIG. 2), which is relatively faster than that on the side of the hub 6 (see FIG. 2), is small. As described above, if the shroud side relative velocity (W/U) of the working fluid 11 is used as a standard, a suppressing of the surge occurrence conflicts with improving the efficiency of the centrifugal compressor 100.

Therefore, in the impeller 1 (see FIG. 2) according to the first embodiment, the shroud side relative velocity (W/U) of working fluid 11 on the side of the leading edge portion a1 is set larger than that of the conventional example, and the shroud side relative velocity (W/U) at a position distant from the leading edge portion a1 is set smaller than that of the conventional example.

For example, as shown by a solid line in FIG. 5, a distribution of the shroud side relative velocity (W/U) of working fluid 11 was designed such that the shroud side relative velocity (W/U) goes up from the leading edge portion a1 and reaches a maximum value, then, decreases to a value lower than that of the conventional example.

Since the centrifugal compressor 100 is provided with the impeller 1, where the shroud side relative velocity (W/U) of working fluid 11 is distributed as described above, the centrifugal compressor 100 (see FIG. 1) can suppress the occurrence of the surge as well as improve the efficiency. Here, a throat position is a position at a foot of a perpendicular from the leading edge 7L (see FIG. 2) of the blade 7 to the pressure side neighboring blade, in some rotating flow surface (here, shroud surface).

In addition, from a correlation between a distribution of the shroud side relative velocity (W/U) of working fluid 11 (see FIG. 2) along the shroud curve line 7*a* in the impeller 1 (see FIG. 1) and a distribution of the blade loading BL along the shroud curve line 7*a* of the blade 7 (see FIG. 2), it was found that, for example, if the shroud side relative velocity (W/U) distributes as shown by the solid line in FIG. 5, the blade loading BL along the shroud curve line 7*a* of the blade 7 distributes as shown by the solid line in FIG. 4. In other words, if the blade loading BL along the shroud curve line 7*a* of the blade 7 is small, the shroud side relative velocity (W/U) is large, and if the blade loading BL is large, the shroud side relative velocity (W/U) is small. And, if the blade loading BL along the shroud curve line 7*a* distributes as shown by the solid line in FIG. 4, the shroud side relative velocity (W/U) distributes as shown by the solid line in FIG. 5.

That is, it is preferable to lower the blade loading BL between the leading edge portion a1 and the vicinity of the throat position for increasing the shroud side relative velocity (W/U) between the leading edge portion a1 (see FIG. 2) and the vicinity of the throat position so as to suppress a reverse flow of the working fluid 11 between the leading edge 7L (see FIG. 2) of the blade 7 and the vicinity of the throat position Then, in the first embodiment, as shown in FIG. 4, the blade loading BL on the side of the shroud curve line 7*a* between the leading edge portion a1 and the vicinity of the throat position is lowered in comparison with the conventional example. The leading edge portion a1 is set to a minimum point $P_{MIN}$ of the blade loading BL, and the blade loading BL at the leading edge portion a1 is set to a minimum value $BL_{MIN}$. In addition, a folding point of the distribution of the blade loading BL dominating the blade loading BL from the leading edge portion a1 to the vicinity of the throat position is named $P_1$, and the blade loading BL at $P_1$ is set to $BL_1$ which can suppress a generation of a reverse flow between the leading edge 7L of the blade 7 and the vicinity of the throat position. An optimal value of the $BL_1$, can be obtained through, for example, experiments. In addition, the blade loading BL at the leading edge portion a1 and the trailing edge portion a2 may be set to 0 (zero) as long as there is not specific reason.

In addition, the folding point $P_1$ where a rate of rise of the blade loading BL discontinuously increases is formed between the leading edge portion a1 and the midpoint ct for abruptly increasing the blade loading BL, and the blade loading BL is increased to the maximum value which is larger than that of the conventional example, then, the blade loading BL is decreased toward the trailing edge a2.

It is noted that the maximum value in the first embodiment is the maximum value $BL_{MAX}$ of the blade loading BL. A point where the blade loading BL has the maximum value $BL_{MAX}$ is named as a maximum point $P_{MAX}$.

In this case, it was found through experiments that if a blade loading $BL_1$, at the folding point $P_1$ is lowered to not more than ⅓ of the maximum value $BL_{MAX}$, the efficiency of the impeller 1 (see FIG. 1) can be increased, and thereby, the efficiency of the centrifugal compressor 100 (see FIG. 1) can be improved.

As shown in FIG. 4, it may be possible to set the folding point $P_1$ of the blade loading BL, for example, in the vicinity of the throat position of the blade 7 (see FIG. 2). That is, it may be possible to distribute the blade loading BL such that the blade loading BL is small at a position between the leading edge portion a1 and the throat position and rapidly increases at a position on the side of the trailing edge portion a2 beyond the throat position. With the configuration described above, it is possible to obtain such an ideal relative velocity distribution that a velocity reduction of the working fluid 11 (see FIG. 2) at the inlet 9*a* of the blade 7 in the impeller 1, which relates to a surge occurrence, is suppressed, and a velocity of the working fluid 11 is rapidly decreased in the downstream beyond the throat position.

In addition, setting the blade loading $BL_1$ at the folding point $P_1$ to not more than ⅓ of the maximum value $BL_{MAX}$ has the following physical meaning. For example, as an example of a standard blade loading BL, assume that the blade loading BL is 0 (zero) at the leading edge portion a1 and the trailing edge portion a2 and reaches a maximum value at the midpoint ct. Generally, the throat position is located at around ⅓ from the leading edge portion a1 between the leading edge portion a1 and the midpoint ct in the camber line length x. Therefore, setting the blade loading $BL_1$ at the folding point $P_1$ to not more than ⅓ of the maximum value $BL_{MAX}$ means that the blade loading BL is set smaller than the blade loading BL at the throat position in a case when the blade loading BL between the leading edge portion a1 and the midpoint ct is linearly connected. Namely, this indicates that the blade loading $BL_1$ at the folding point $P_1$ is set smaller than that of the conventional one.

Then, setting the blade loading $BL_1$ at the folding point $P_1$ to not more than ⅓ of the maximum value $BL_{MAX}$ has the same meaning as securing a surge margin more than ever, and it is preferable to set the blade loading $BL_1$ at the folding point $P_1$ to further smaller value for further securing the surge margin.

If a distribution of the blade loading BL along the shroud curve line 7*a* (see FIG. 2) of the blade 7 is determined as described above, a shape of the shroud curve line 7*a* can be determined using an inverse design method. The inverse design method is a method where, for example, a desired distribution of the blade loading BL is calculated first, and subsequently, a shape of the blade 7 is determined based on the distribution. Therefore, the desired distribution of the blade loading BL can be easily realized in comparison with a normal design method, where a shape of the blade 7 is determined first.

For example, at a point Pa shown in FIG. 3A, when a radius is r, a circumferential average absolute velocity of the working fluid 11 (see FIG. 1) is $C_\theta$, and a camber line length is x, the blade loading BL at the point Pa is a derivative of a product $[r \cdot C_\theta]$, which is a product of the circumferential average absolute velocity $C_\theta$ and the radius r, differentiated with respect to the camber line length x, and expressed in the next formula (2).

$$BL = \frac{d(r \cdot C_\theta)}{dx} \tag{2}$$

Therefore, if the blade loading BL at the point Pa is determined, a relation between the camber line length x and the radius r corresponding to the circumferential average absolute velocity $C_\theta$ of the working fluid 11 can be calculated. Then, for example, based on the formula (1), the blade angle β can be set.

Namely, if the blade loading BL is determined, the blade angle β can be set using the inverse design method, and in addition, by continuously setting the blade angle β along the shroud curve line 7*a*, a shape of the shroud curve line 7*a* can be determined.

A shape of the hub curve line 7*b* (see FIG. 2) may be determined using an inverse design method by calculating a desired distribution of the blade loading BL along the hub curve line 7*b* as with the shroud curve line 7*a*.

However, as described above, an effect of the distribution of the blade loading BL along the hub curve line 7*b*, that is, the effect of the distribution of the relative velocity of the working fluid 11 (see FIG. 2) along the hub curve line 7*b* on a performance of the centrifugal compressor 100 (see FIG. 1) is smaller than the effect of the distribution of the shroud side relative velocity (W/U) along the shroud curve line 7*a*.

Then, in the first embodiment, a shape of the hub curve line 7*b* is determined focusing on improvement of strength of the blade 7 shown in FIG. 2.

For example, it is known that a strength of the blade 7 increases if the trailing edge portion b2 of the hub curve line 7*b* is inclined at a given angle against the trailing edge portion a2 of the shroud curve line 7*a*. An angle of the trailing edge portion b2 of the hub curve line 7*b* to be inclined against the trailing edge portion a2 of the shroud curve line 7*a* is hereinafter called as rake angle $L_\theta$.

Figure 6A:
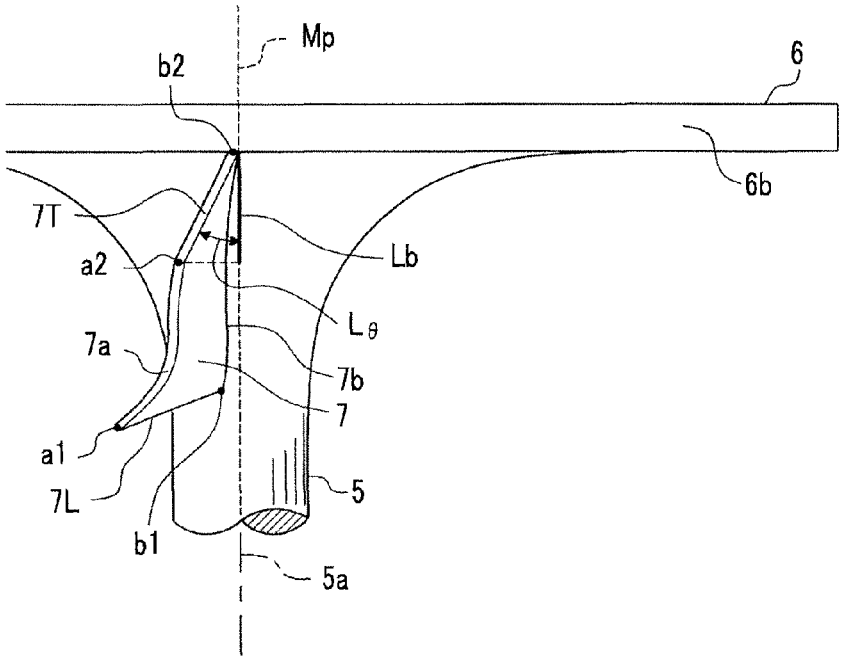
FIG. 6A is an illustration for explaining a rake angle according to the first embodiment.

FIG. 6A is an illustration for explaining a rake angle according to the first embodiment. As shown in FIG. 6A, the rake angle $L_\theta$ is an angle between the meridian plane Mp at the trailing edge portion b2 of the hub curve line 7*b* and the trailing edge 7T. In more detail, the rake angle $L_\theta$ is an angle between a straight line Lb which is produced by projecting the trailing edge 7T on the meridian plane Mp at the trailing edge portion b2 and the trailing edge 7T, and the rake angle $L_\theta$ where the trailing edge 7T inclines to a direction to which the impeller 1 rotates is defined as a positive angle.

The rake angle $L_\theta$ as defined above is an important index for determining strength of the trailing edge 7T where a stress is the largest in the blade 7. Especially, in the impeller 1 whose circumferential velocity is large or whose pressure ratio is high, the strength of the blade 7 largely depends on the rake angle $L_\theta$.

Accordingly, in the first embodiment, a shape of the blade 7 is determined by defining the rake angle $L_\theta$.

In addition, the hub curve line 7*b* is determined so that an angle between the meridian plane Mp and the leading edge 7L (hereinafter, referred to as leading edge angle $F_\theta$) becomes a predetermined angle.

Figure 6B:
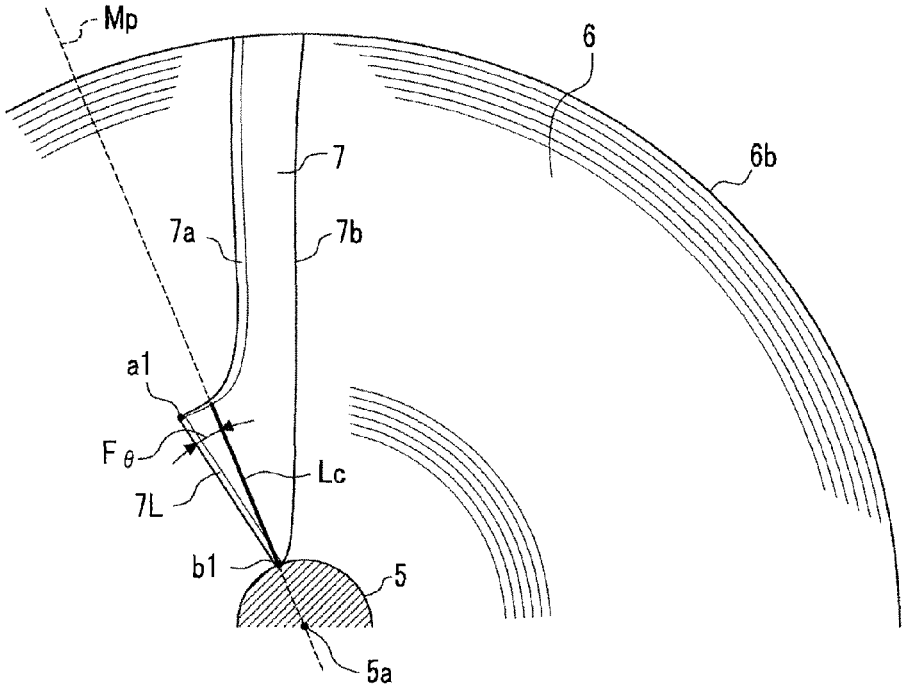
FIG. 6B is an illustration for explaining a leading edge angle of a rake.

FIG. 6B is an illustration for explaining a leading edge angle. As shown in FIG. 6B, the leading edge angle $F_\theta$ is an angle between the meridian plane Mp at the leading edge portion b1 and the leading edge 7L. In more detail, the leading edge angle $F_\theta$ is an angle between a straight line Lc which is produced by projecting the leading edge 7L on the meridian plane at the leading edge portion b1 and the leading edge 7L, and the leading edge angle $F_\theta$ where the leading edge 7L inclines to a direction to which the impeller 1 rotates is defined as a positive angle.

In the first embodiment, the rake angle $L_\theta$ is set between 0° and +45° and the leading edge angle $F_\theta$ is set between −10° and +10°, based on the analysis of experiments.

Figure 7:
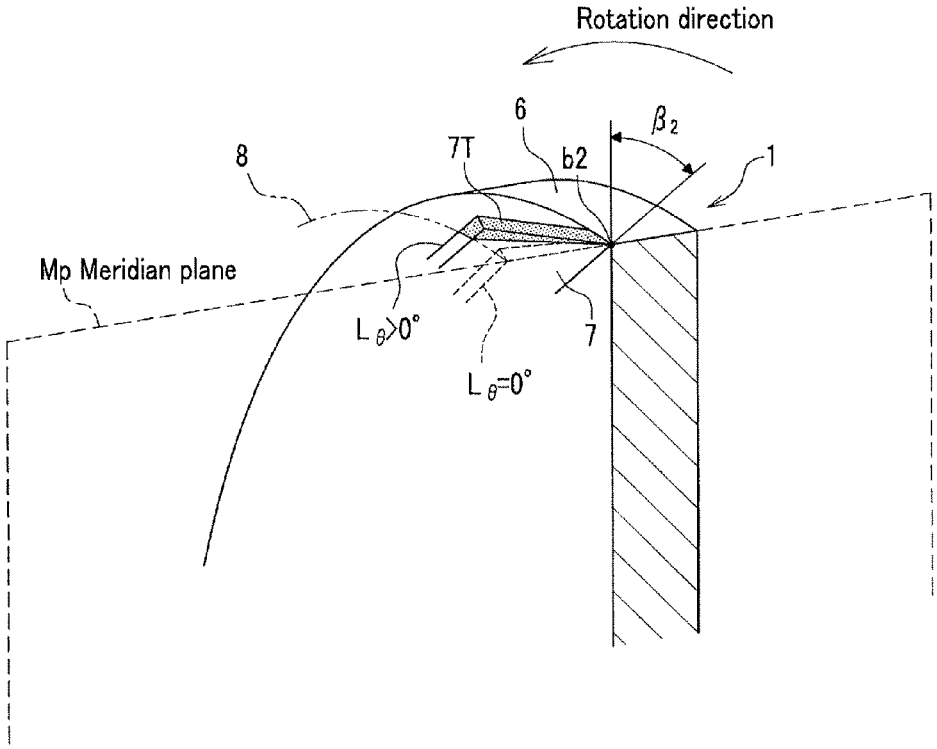
FIG. 7 is an illustration showing a condition where a weight of a blade is reduced depending on a rake angle.

FIG. 7 is an illustration showing a condition where a weight of a blade is reduced depending on a rake angle.

As shown in FIG. 6B, a radial direction where a centrifugal force works and a direction of the leading edge 7L approach the same direction if the leading edge angle $F_\theta$ is decreased close to 0 (zero) on the side of the leading edge 7L where the blade 7 is high, and a bending stress of the hub curve line 7*b* at the leading edge portion b1, which is generated because the leading edge portion a1 of the shroud curve line 7*a* is pulled in the radial direction by the centrifugal force, becomes small.

On the other hand, as shown in FIG. 7, with respect to the side of the trailing edge 7T, considering that the impeller 1 including the blade 7 is cut at a predetermined radius of the circumference and the trailing edge 7T of the blade 7 is inclined to the reverse direction of the rotation direction (blade angle $\beta_2$ is negative), there is a tendency that a weight of the blade 7 to be supported by the trailing edge portion b2 becomes smaller when the rake angle $L_\theta$ is a positive value in comparison with a negative value, thereby resulting in reduction of the stress.

That is, as shown in FIG. 7, when the rake angle $L_\theta$ of the blade 7 is larger than 0° (positive value), a weight of a portion indicated by dots is reduced in comparison with the blade 7 whose rake angle $L_\theta$ is 0°, which is indicated by the dotted line.

It was found that a stress by a total force of a centrifugal force operating on the blade 7 shown in FIG. 2, a bending force by the working fluid 11 and a transmitting force inside the blade 7 can be reduced by setting the rake angle $L_\theta$ and the leading edge angle $F_\theta$ as described above, and accordingly, the impeller 1 which can endure a large circumferential velocity and high pressure ratio can be manufactured.

Further, the hub curve line 7*b* is created by connecting the leading edge portion b1 and trailing edge portion b2 so that the blade 7 shown in FIG. 2 has a preferable strength and a fluid performance.

Hence, as described above, the blade 7 can be created by connecting the shroud curve line 7*a* and the hub curve line 7*b*.

In the blade 7 which has the hub curve line 7*b* where the strength is considered, a height of the blade 7 (see FIG. 2) can be high. Then, by increasing the height of the blade 7, a passage area of the passage 9 (see FIG. 1) can be enlarged, and the centrifugal compressor 100 (see FIG. 1) having a large flow rate of the working fluid 11 (see FIG. 2) can be configured. For example, a flow coefficient (suction flow coefficient ϕ1) which is an index indicating a flow volume of the working fluid 11 can be set between 0.09 and 0.15.

The suction flow coefficient ϕ1 is a non-dimensional number expressed by the next formula (3), which is inversely proportion a1 to the square of an outer diameter $D_2$ [m] of the impeller 1 (see FIG. 1) and a circumferential velocity $U_2$ [m/s] of the impeller 1, and proportional to a flow volume (volumetric flow rate) Q [$m^3$/s] of the working fluid 11 (see FIG. 1).

$$\phi_1 = \frac{Q}{0.25 \cdot \pi \cdot D_2^2 \cdot U_2} \tag{3}$$

That is, the suction flow coefficient ϕ1 expressed by the formula (3) is an index indicating a flow rate of the working fluid 11 flowing in the centrifugal compressor 100 (see FIG. 1), and the flow rate of the working fluid 11 can be set larger as the suction flow coefficient ϕ1 of the centrifugal compressor 100 becomes larger, thereby resulting in improvement of the efficiency (pressure ratio).

Figure 8:
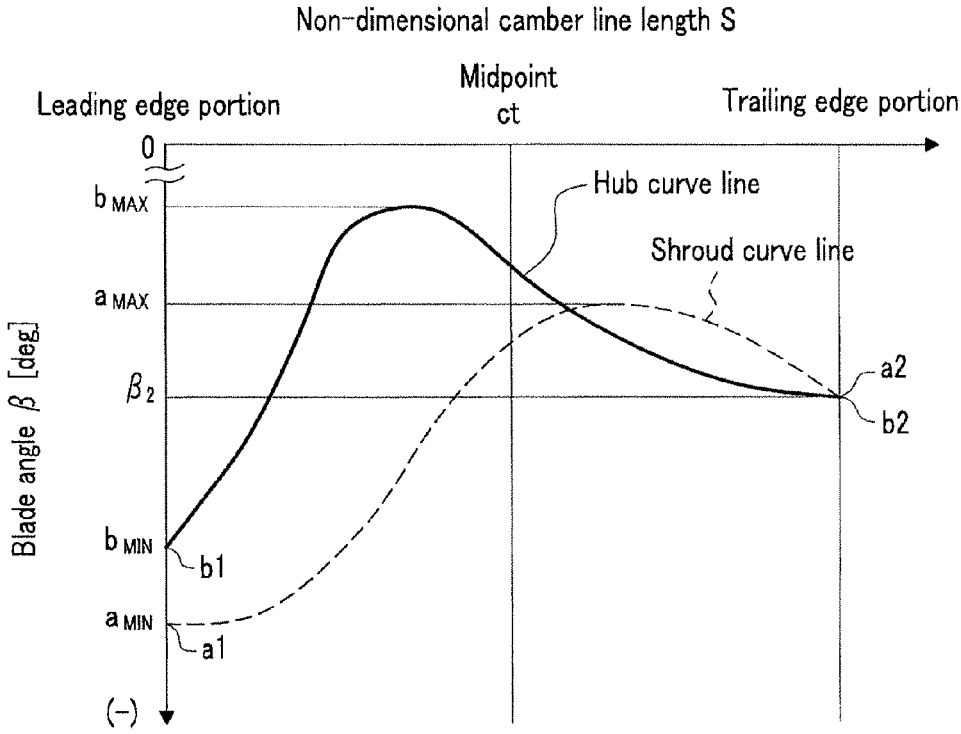
FIG. 8 is a graph showing a blade angle distribution of a centrifugal compressor according to the first embodiment.

FIG. 8 is a graph showing a blade angle distribution of a centrifugal compressor according to the first embodiment.

The vertical axis of FIG. 8 indicates a blade angle β (The blade angle β is a negative value according to the definition of the formula (1)) of the blade 7 (see FIG. 2), and the horizontal axis indicates the non-dimensional camber line length S.

Referring to FIG. 8, a shape of the blade 7 of the impeller 1 shown in FIG. 2 will be explained.

First, a shape of the shroud curve line 7*a* will be explained.

A blade angle β on the side of the shroud curve line 7*a* is small in the vicinity of the leading edge portion a1, and has a minimum value (minimum value $a_{MIN}$) at a position between the leading edge portion a1 and the midpoint ct.

After that, the blade angle β on the side of the shroud curve line 7*a* increases from the minimum value $a_{MIN}$ and has a maximum value (maximum value $a_{MAX}$) at a point between the midpoint ct and trailing edge portion a2, then, decreases toward the trailing edge portion a2.

As described above, since the blade angle β has a minimum value (minimum value $a_{MIN}$), a change of the blade angle β in the vicinity of the leading edge portion a1 becomes small, and as shown by the solid line in FIG. 4, this corresponds to a small blade loading BL in the vicinity of the leading edge portion a1.

Furthermore, this corresponds to a small change of a flowing direction of the working fluid 11 flowing into the impeller 1 shown in FIG. 1. Therefore, at the leading edge portion a1, a velocity of the working fluid 11 flown into the impeller 1 may be maintained, or accelerated a little, and accordingly, a surge occurrence at the leading edge portion a1 can be delayed. Namely, a surge limit can be decreased, and an operating range of the centrifugal compressor 100 can be expanded.

In addition, the blade angle β is rapidly increased at a position from 0.3 to 0.5 of the non-dimensional camber line length S, which corresponds to the vicinity of the throat position.

The rapid increase of the blade angle β corresponds to the blade loading BL before and after the folding point P1 shown by the solid line in FIG. 4. An area having a large blade loading BL is an area where a velocity of the working fluid 11 (see FIG. 2) rapidly decreases, and the velocity of the working fluid 11 can be decreased in the upstream close to the leading edge portion a1. By decreasing the velocity of the working fluid 11 as described above, a fluid loss can be decreased, thereby resulting in improvement of efficiency of the centrifugal compressor 100 (see FIG. 1).

In addition, the maximum value (maximum value $a_{MAX}$) of the blade angle β on the side of the shroud curve line 7*a*, which is located at a position between the midpoint ct and the trailing edge portion a2, contributes to improve the efficiency of the centrifugal compressor 100 by the following reasons.

When the efficiency is prioritized in designing the centrifugal compressor 100 (see FIG. 1), it is required that the shroud side relative velocity (W/U), which largely effects on the efficiency, is decreased in the upstream of the impeller 1 (see FIG. 1) as upper side as possible. A position where the shroud side relative velocity (W/U) is decreased and an amount of the decrease of the shroud side relative velocity (W/U) have a close relation to a position where the blade angle β on the side of the shroud curve line 7*a* (see FIG. 2) rapidly increases and a gradient of the increase. Therefore, when the efficiency is prioritized in the designing, the blade angle β on the side of the shroud curve line 7*a* is rapidly increased in the first half (upstream side) of the impeller 1. Considering that the blade angle β at the trailing edge 7T (see FIG. 2) of the blade 7 is determined by specifications, the maximum value (maximum value $a_{MAX}$) of the blade angle β becomes larger when the efficiency is prioritized more. As a result, when the efficiency is prioritized in the designing, the maximum value (maximum value $a_{MAX}$) of the blade angle β appears at a position between the midpoint ct and the trailing edge portion a2 on the side of the shroud curve line 7*a* (see FIG. 2).

In FIG. 8, the blade angle β on the side of the shroud curve line 7*a* (see FIG. 2) has the minimum value $a_{MIN}$ at the leading edge portion a1, but not limited to this position. The blade angle β on the side of the shroud curve line 7*a* may have the minimum value $a_{MIN}$ at a position between the leading edge portion a1 and the midpoint ct. In addition, the blade angle β of each of the shroud curve line 7*a* and the hub curve line 7*b* (see FIG. 2) has the same blade angle $\beta_2$ at the trailing edge portions a2, b2. The blade angle β on the side of the shroud curve line 7*a* at the trailing edge portion a2 and the blade angle β on the side of the hub curve line 7*b* at the trailing edge portion b2 are values to be determined based on the specifications of the centrifugal compressor 100 see FIG. 1). A design, where the blade angle β on the side of the shroud curve line 7*a* at the trailing edge portion a2 and the blade angle β on the side of the hub curve line 7*b* at the trailing edge portion b2 have the same blade angle $\beta_2$, is common.

The blade angle β on the side of the hub curve line 7*b* (see FIG. 2) has a minimum value $b_{MIN}$ at the leading edge portion b1. The blade angle β increases toward the midpoint ct and reaches a maximum value (maximum value $b_{MAX}$) at a position between the leading edge portion b1 and the midpoint ct, then, decreases toward the trailing edge portion b2. As described, the hub curve line 7*b* is a curve having a single maximum value at a position between the leading edge portion b1 and the midpoint ct.

This, as will be described later, relates to a reduction of a secondary flow loss of the impeller 1 (see FIG. 1).

The secondary flow loss of the impeller 1 is a loss caused by a velocity difference between the relative velocity on the side of the shroud 8 (see FIG. 2) and the relative velocity on the side of the hub 6 (see FIG. 2) of the working fluid 11 (see FIG. 1). A flow toward the shroud 8 from the hub 6 (secondary flow), which is generated so as to absorb the velocity difference, becomes larger as the velocity difference becomes larger. Due to the secondary flow generated as described above, the secondary flow loss is generated.

Since the hub 6 (see FIG. 2) is located on an inner side rather than the shroud 8 (see FIG. 2) in the radial direction, a relative velocity on the side of the hub 6 becomes small in general in comparison with the relative velocity on the side of the shroud 8. Therefore, a generation of the secondary flow loss can be suppressed by increasing the relative velocity on the side of the hub 6 close to the relative velocity on the side of the shroud 8 (shroud side relative velocity (W/U)) as early as possible.

Considering that a mass flow is preserved from the inlet 9*a* (see FIG. 2) to the outlet 9*b* (see FIG. 2) of the blade 7 in the impeller 1, it may be assumed that a meridional velocity Cm at an arbitrary point on the side of the hub 6 is constant regardless of the blade angle β. In addition, considering that the meridional velocity Cm is equal to a projected component of the relative velocity on the meridian plane Mp (see FIG. 3A), a relative velocity of a flow flowing along the blade 7 becomes larger as the blade angle β becomes larger.

On the other hand, the blade angle β (minimum value $b_{MIN}$) at the leading edge portion b1 and the blade angle β (blade angle $\beta_2$) at the trailing edge portion b2 of the hub curve line 7*b* (see FIG. 2) of the impeller 1 are determined based on the specifications (for example, rotation velocity, flow rate and characteristics of working fluid) of the centrifugal compressor 100 (see FIG. 1).

Therefore, it is effective for suppressing the secondary flow loss in the impeller 1 to bring a velocity on the side of the hub 6 (see FIG. 2) close to the velocity on the side of the shroud 8 as early as possible, and accordingly, it is required that after the blade angle β on the side of the hub 6 is rapidly increased in the first half (upstream side) of the impeller 1, the blade angle β is brought close to the blade angle β (blade angle $\beta_2$) at the trailing edge 7T (see FIG. 2)

A velocity difference between the velocity on the side of the hub 6 (see FIG. 2) and the velocity on the side of the shroud 8 (see FIG. 2) depends on a magnitude of the flow coefficient of the centrifugal compressor 100 (see FIG. 1). In the impeller 1 (see FIG. 1) having a target flow coefficient of the centrifugal compressor 100 according to the first embodiment, since the flow difference at the inlet 9*a* (see FIG. 2) is large, it is required that the blade angle β on the side of the hub curve line 7*b* (see FIG. 2) has a larger maximum value than the blade angle $\beta_2$ at the trailing edge portion b2 for ideally decreasing the flow difference.

Considering the above, the blade angle β on the side of the hub curve line 7*b* has a distribution having the single maximum value $b_{MAX}$ (maximum value) at a position between the leading edge portion b1 and the midpoint ct, as shown in FIG. 8. By distributing the blade angle β on the side of the hub curve line 7*b* as described above, the impeller 1 having a high reliability and high efficiency (small secondary flow loss) can be configured.

The shroud curve line 7*a* intersects with the hub curve line 7*b* at a position between the midpoint ct and the trailing edge portions a2, b2. That is, a point where the blade angle β on the side of the shroud curve line 7*a* and the blade angle β on the side of the hub curve line 7*b* have the same value exists at a position between the midpoint ct and the trailing edge portions a2, b2.

A magnitude relation between the blade angle β on the side of the shroud curve line 7*a* (see FIG. 2) and the blade angle β on the side of the hub curve line 7*b* (see FIG. 2) at the leading edge portions a1, b1 (see FIG. 2) and the trailing edge portions a2, b2 (see FIG. 2) is determined based on the specifications of the centrifugal compressor 100 (see FIG. 1). The above-described intersection of the blade angle β occurs when the efficiency is prioritized in the designing.

When the efficiency is prioritized in the designing, it is required that a relative velocity (shroud side relative velocity (W/U)) on the side of the shroud 8 (see FIG. 2), which largely effects on the efficiency, is decreased in the upstream of the impeller 1 (see FIG. 2) as upper side as possible. A position where the shroud side relative velocity (W/U) is decreased and an amount of the decrease of the shroud side relative velocity (W/U) have a close relation to a position where the blade angle β on the side of the shroud curve line 7*a* (see FIG. 2) rapidly increases and a gradient of the increase. Therefore, when the efficiency is prioritized in the designing, the blade angle β on the side of the shroud curve line 7*a* rapidly increases in the first half (upstream side) of the impeller 1. Considering that the blade angle β at the trailing edge portion a2 is determined by specifications, the maximum value $a_{MAX}$ of the shroud curve line 7*a* becomes larger when the efficiency is prioritized more.

In addition, in view of securing a necessary surge margin, a position where the blade angle β on the side of the shroud curve line 7*a* (see FIG. 2) rapidly increases can not be moved to the upstream unnecessarily.

Accordingly, when the design is conducted in consideration of securing a minimum necessary surge margin and prioritizing the efficiency, a point where the blade angle β on the side of the shroud curve line 7*a* (see FIG. 2) intersects with the blade angle β on the side of the hub curve line 7*b* (see FIG. 2) appears at a position between the midpoint ct and the trailing edge portions (a2, b2), as shown in FIG. 8.

A performance of the impeller 1 (see FIG. 1) provided with the blade 7 (see FIG. 2) which has the above-described shapes of the shroud curve line 7*a* and the hub curve line 7*b* was measured.

Figure 9:
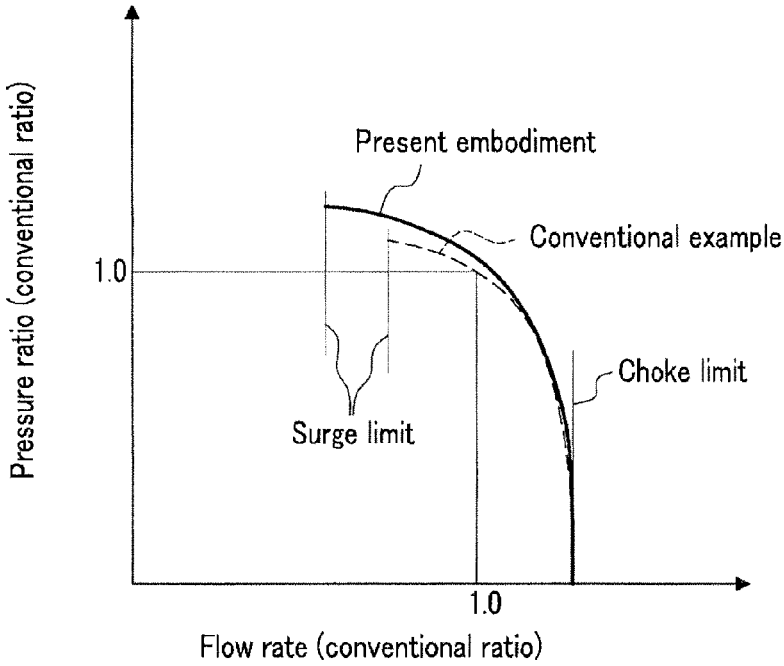
FIG. 9 is a graph showing a performance curve of an impeller.

FIG. 9 is a graph showing a performance curve of an impeller. As shown by a solid line in FIG. 9, the impeller 1 according to the first embodiment can obtain a higher pressure ratio than that of the conventional sample shown by a dotted line. In addition, the impeller 1 can operate with a smaller flow rate of the working fluid 11 (see FIG. 1) without causing an occurrence of a surge in comparison with the conventional example. That is, the surge limit can be decreased. Meanwhile, a choke limit is a maximum flow rate of the working fluid 11 capable of operating the impeller 1. A value of the choke limit is identical to that of the conventional example.

Then, an operating range of the centrifugal compressor 100 (see FIG. 1) provided with the impeller 1 according to the first embodiment can be expanded. In addition, a strength of the blade 7 can be increased by suitably setting the rake angle $L_\theta$ (0° to +45°) at the trailing edge 7T of the blade 7 shown in FIG. 6A and the leading edge angle $F_\theta$ (−10° to +10°) at the leading edge 7L of the blade 7 shown in FIG. 6B.

Accordingly, the impeller 1 which can rotate at high speed and which can enlarge the circumferential velocity can be configured.

Meanwhile, a distribution of the blade loading BL along the shroud curve line 7*a* (see FIG. 2) according to the first embodiment has the folding point $P_1$ at the throat position as shown in FIG. 4. However, there may be a distribution without the folding point $P_1$.

Figure 10:
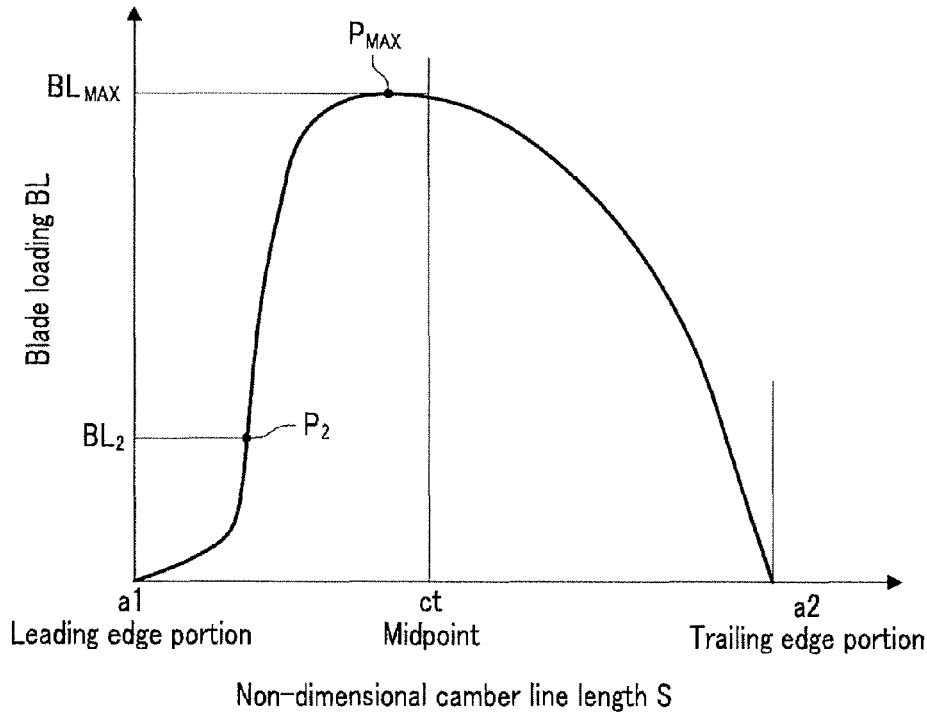
FIG. 10 is a graph showing a blade loading distribution having an inflection point.

FIG. 10 is a graph showing a blade loading distribution having an inflection point. In the blade 7 according to the first embodiment, since a distribution of the blade loading BL along the shroud curve line 7*a* is sufficient as long as the blade loading BL rapidly increases in the vicinity of the leading edge portion a1, the distribution of the blade loading BL may be the one where the blade loading BL smoothly increases as shown in FIG. 10. In this case, the distribution of the blade loading BL can be smoothed by forming the inflection point $P_2$ as shown in FIG. 10

When the inflection point $P_2$ is formed on the distribution of the blade loading BL along the shroud curve line 7*a* (see FIG. 2), it was found through experiments that if the blade loading $BL_2$ at the inflection point $P_2$ is smaller than ⅓ of the maximum value $BL_{MAX}$ of the blade loading BL, the efficiency of the impeller 1 (see FIG. 1) can be improved, and a pressure ratio of the centrifugal compressor 100 (see FIG. 1) can be improved.

A distribution of the blade loading BL of the blade 7 (see FIG. 1) in the centrifugal compressor 100 depends on a curvature distribution of a blade surface of the blade 7. Therefore, a shape of the blade surface of the blade 7, where the blade loading BL has the inflection point $P_2$ as shown in FIG. 10 and distributes smoothly, is smooth, and an aerodynamic loss due to, for example, growing of a boundary layer can be decreased.

As described above, in the blade 7 (see FIG. 1) of the centrifugal compressor 100 according to the first embodiment, a distribution of the blade angle β on the side of the shroud curve line 7*a* (see FIG. 2) is determined based on a distribution of the blade loading BL along the shroud curve line 7*a*. As a result, an operating range of the centrifugal compressor 100 can be expanded, and the efficiency and the pressure ratio thereof can be increased, thereby resulting in achievement of the excellent effects.

Accordingly, a shape of the blade 7 (shape of shroud curve line 7*a*) having a desired distribution of the blade loading BL can be easily determined by determining a shape of the shroud curve line 7*a* from the desired distribution of the blade loading BL, by using an inverse design method.

In addition, since the blade angle β on the side of the hub curve line 7*b* (see FIG. 2) is determined based on a strength of the blade 7 (see FIG. 1), the impeller 1 (see FIG. 1) provided with the blade 7 having a high strength can be obtained.

Especially, if the rake angle $L_\theta$ shown in FIG. 6A is set to a range from 0° to +45° and the leading edge angle $F_\theta$ shown in FIG. 6B is set to a range from −10° to +10°, a stress to be generated in the blade 7 can be suppressed and strength of the blade 7 can be improved.

Namely, the centrifugal compressor 100 (see FIG. 1) which is provided with the impeller 1 (see FIG. 1) capable of improving the pressure ratio as well as expanding the operating range and further capable of increasing the circumferential velocity by using the blade 7 (see FIG. 1) according to the first embodiment can be configured.

<<Second Embodiment>>

Next, a second embodiment of the present invention will be explained. Assuming that a centrifugal compressor and components thereof according to the second embodiment are identical to those of the centrifugal compressor 100 and components thereof shown in FIG. 1 and FIG. 2, the explanation will be omitted as appropriate.

Figure 11:
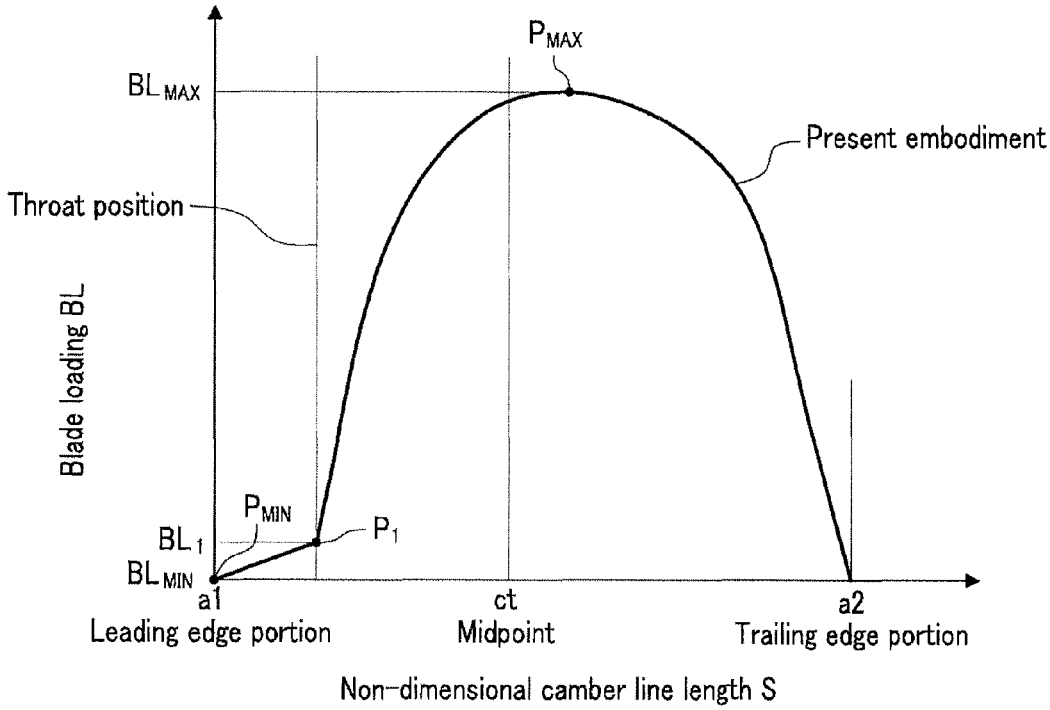
FIG. 11 is a graph showing a blade loading distribution along a shroud curve line against a non-dimensional camber line length according to a second embodiment of the present invention.
Figure 12:
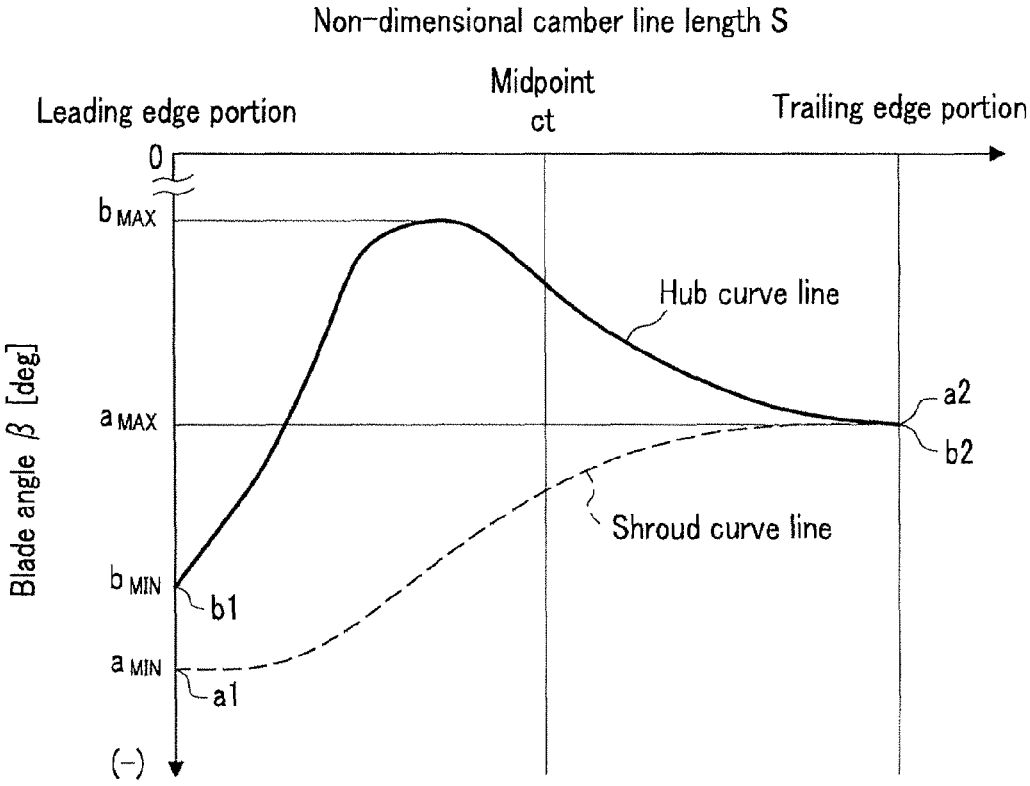
FIG. 12 is a graph showing a blade angle distribution corresponding to a blade loading distribution.

FIG. 11 is a graph showing a blade loading distribution along a shroud curve line against a non-dimensional camber line length according to a second embodiment of the present invention. FIG. 12 is a graph showing a blade angle distribution corresponding to a blade loading distribution. As shown in FIG. 11, a distribution of the blade loading BL of the blade 7 (see FIG. 2) according to the second embodiment on the side of the shroud 8 (see FIG. 8) has a maximum value at a position between the midpoint ct and the trailing edge portion a2 of the non-dimensional camber line length S.

The blade angle β on the side of the shroud curve line 7*a* (see FIG. 2) has a maximum value $a_{MAX}$ at the trailing edge portion a2 as shown in FIG. 12, corresponding to that the blade loading BL of the shroud 8 distributes so as to have a maximum value at a position between the midpoint ct and the trailing edge portion a2 as shown in FIG. 11. In addition, the blade angle β at the trailing edge portion b2 of the hub curve line 7*b* (see FIG. 2) has substantially the same value with the maximum value $a_{MAX}$. Therefore, the blade angle β on the side of the hub curve line 7*b* does not intersect with the blade angle β on the side of the shroud curve line 7*a*.

As described above, by distributing the blade angle β on the side of the shroud curve line 7*a* so that the blade angle β reaches the maximum value $a_{Max}$ at the trailing edge portion a2 of the shroud curve line 7*a* (see FIG. 2), the blade angle β on the side of the shroud curve line 7*a* changes more gradually, and a relative velocity of the working fluid 11 (see FIG. 2) on the side of the shroud 8 (see FIG. 2) decreases more gradually as a peak of the blade loading approaches the trailing edge portion.

If the relative velocity of the working fluid 11 (see FIG. 2) on the side of the shroud 8 (see FIG. 2) decreases gradually, the efficiency decreases a little, however, the surge margin can be expanded. Accordingly, it is possible to substantially expand the surge margin by using the impeller 1 (see FIG. 2) provided with the blade 7 (see FIG. 2) where the blade loading BL distributes as shown in FIG. 11 and the blade angle β distributes as shown in FIG. 12.

The centrifugal compressors according to the embodiments described above can be designed by adjusting a camber line length x having a maximum value of the blade loading in designing a centrifugal compressor where the blade angle on the side of the shroud distributes so that the blade loading has a minimum value at the leading edge, increases from the minimum value along a camber line on the side of the shroud and reaches a maximum value, and decreases from the maximum value along the camber line on the side of the shroud toward the trailing edge, while maintaining a magnitude of the minimum value of the blade loading so that a reverse flow of the working fluid at the leading edge is suppressed.

If the blade angle β on the side of the shroud curve line 7*a* (see FIG. 2) distributes so that the blade angle β has the maximum value $a_{MAX}$ at a position on the shroud curve line 7*a* closer to the trailing edge portion a2 by moving the position $P_{MAX}$ of the maximum value $BL_{MAX}$ of the blade loading BL closer to the trailing edge, the blade angle β on the side of the shroud curve line 7*a* changes more gradually, and thereby, a relative velocity on the side of the shroud 8 (see FIG. 2) of the working fluid 11 (see FIG. 2) decreases more gradually. As a result, it becomes possible to design a centrifugal compressor which has a wide operating range.

On the other hand, if the efficiency is prioritized in the designing, it is required that a relative velocity on the side of the shroud 8 (the shroud side relative velocity (W/U)), which largely effects on the efficiency, is decreased in the upstream of the impeller 1 (see FIG. 2) as upper side as possible. A position where the shroud side relative velocity (W/U) is decreased and an amount of the decrease have a close relation to a position where the blade angle β on the side of the shroud curve line 7*a* (see FIG. 2) rapidly increases and a gradient of the increase. Therefore, if the blade angle β on the side of the shroud curve line 7*a* distributes so that the blade angle β has the maximum value $a_{MAX}$ at a position of the shroud curve line 7*a* (see FIG. 2) closer to the leading edge portion a1 by moving the position $P_{MAX}$ of the maximum value $BL_{MAX}$ of the blade loading BL closer to the leading edge, it becomes possible to design a centrifugal compressor which prioritizes the efficiency.

What is claimed is:

1. A centrifugal compressor provided with an impeller which is configured to have a plurality of blades arranged at a predetermined interval in a circumferential direction of a hub rotating together with a rotation shaft, wherein a blade angle relative to a meridian plane on a shroud side of the blade distributes to have a minimum value at a position between a leading edge of the blade and a midpoint of a camber line on the shroud side, and a maximum value at a position between the midpoint of the camber line on the shroud side and a trailing edge of the blade;

wherein the blade angle of the blade relative to the meridian plane on a hub side distributes so as to have a maximum value at a position between a leading edge and a midpoint of a camber line on the hub side;

wherein if a blade loading at an arbitrary point of the camber line on the shroud side is a derivative of a product of a circumferential average absolute velocity $C_\theta$ and a radius r differentiated with respect to a camber line length x as shown by the following formula, $$\frac{d(r \cdot C_\theta)}{dx}$$

where, r is a radius from an axis center of the rotation shaft at an arbitrary point of the camber line on the shroud side, $C_\theta$ is a circumferential average absolute velocity of a working fluid flowing in a passage formed in the impeller, and x is a camber line length which is a length measured along the camber line on the shroud side from the leading edge to the arbitrary point of the camber line on the shroud side, then the blade angle on the shroud side distributes such that the blade loading has a minimum value at the leading edge, increases from the minimum value along the camber line on the shroud side and reaches a maximum value, and decreases from the maximum value toward the trailing edge along the camber line on the shroud side, while maintaining a magnitude of the minimum value of the blade loading so that a reversed flow of the working fluid at the leading edge is suppressed;

wherein a distribution of the blade loading along the camber line on the shroud side has an inflection point at which a rate of rise of the blade loading changes or has a folding point where a rate of rise of the blade loading discontinuously increases at a position between a minimum point of the minimum value of the blade loading and a maximum point of the maximum value of the blade loading, the position being between the leading edge and the midpoint of the camber line on the shroud side;

wherein the blade loading at the inflection point or the folding point is not more than ⅓ of the maximum value of the blade loading; and wherein the inflection point is a throat position of the blade.

2. The centrifugal compressor according to claim 1, wherein the blade angle on the shroud side has a maximum value at the trailing edge.

3. The centrifugal compressor according to claim 1, wherein the blade angle on the hub side is larger than the blade angle on the shroud side at a position between the leading edge and the midpoint of the camber line on the hub side, and smaller than the blade angle on the shroud side at a part of a position between the midpoint and the trailing edge of the camber line on the hub side.

4. The centrifugal compressor according to claim 1, wherein the blade loading increases from the minimum value along the camber line on the shroud side and reaches a maximum value at a position between the leading edge and the midpoint.

5. The centrifugal compressor according to claim 1, wherein the blade loading increases from the minimum value along the camber line on the shroud side and reaches a maximum value at a position between the midpoint and the trailing edge.

6. The centrifugal compressor according to claim 1, wherein a suction flow coefficient is in a range from 0.09 to 0.15.

7. A method for manufacturing a centrifugal compressor provided with an impeller which is configured to have a plurality of blades arranged at a predetermined interval in a circumferential direction of a hub rotating together with a rotation shaft, the method comprising steps of:

distributing a blade angle relative to a meridian plane on a shroud side of the blade to have a minimum value at a position between a leading edge of the blade and a midpoint of a camber line on the shroud side, and a maximum value at a position between the midpoint of the camber line on the shroud side and a trailing edge of the blade; and distributing a blade angle of the blade relative to the meridian plane on a hub side so as to have a maximum value at a position between a leading edge and a midpoint of a camber line on the hub side;

providing a distribution of the blade loading along the camber line on the shroud side to have an inflection point at which a rate of rise of the blade loading changes or to increase a folding point where a rate of rise of the blade loading discontinuously at a position between a minimum point of the minimum value of the blade loading and a maximum point of the maximum value of the blade loading, the position being between the leading edge and the midpoint of the camber line on the shroud side; and being the inflection point a throat position of the blade.

8. The method for manufacturing a centrifugal compressor according to claim 7, further comprising a step of:

determining a distribution of the blade angle on the shroud side from a distribution of the blade loading along the camber line on the shroud side by using an inverse design method.

* * * * *